US009772604B2

(12) United States Patent
Winkler et al.

(10) Patent No.: US 9,772,604 B2
(45) Date of Patent: Sep. 26, 2017

(54) TIMEPIECE SYNCHRONIZATION MECHANISM

(71) Applicant: ETA SA Manufacture Horlogere Suisse, Grenchen (CH)

(72) Inventors: Pascal Winkler, Marin (CH); Jean-Luc Helfer, Le Landeron (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 15/104,135

(22) PCT Filed: Dec. 8, 2014

(86) PCT No.: PCT/EP2014/076936
§ 371 (c)(1),
(2) Date: Jun. 13, 2016

(87) PCT Pub. No.: WO2015/096974
PCT Pub. Date: Jul. 2, 2015

(65) Prior Publication Data

US 2016/0327908 A1 Nov. 10, 2016

(30) Foreign Application Priority Data

Dec. 23, 2013 (CH) ..... 2140/13
Dec. 23, 2013 (EP) ..... 13199427
(Continued)

(51) Int. Cl.
*G04B 17/32* (2006.01)
*G04B 15/08* (2006.01)
(Continued)

(52) U.S. Cl.
CPC ..... *G04B 15/08* (2013.01); *G04B 15/12* (2013.01); *G04B 15/14* (2013.01); *G04B 17/32* (2013.01); *G04C 5/005* (2013.01)

(58) Field of Classification Search
CPC ..... G04C 5/005; G04C 3/064; G04C 3/06; G04C 3/105; G04B 15/14; G04B 15/08; G04B 17/32; G04B 15/12
See application file for complete search history.

(56) References Cited

U.S. PATENT DOCUMENTS 3,052,084 A 9/1962 Widmer
8,534,910 B2 * 9/2013 Baudet ..... G04C 3/047 368/126
(Continued)

FOREIGN PATENT DOCUMENTS

EP 2 544 370 A1 1/2013
GB 1 049 638 A 11/1966
WO 2006/045824 A2 5/2006

OTHER PUBLICATIONS

International Search Report issued Aug. 5, 2015 in PCT/EP2014/076936 filed on Dec. 8, 2014.

*Primary Examiner* — Sean Kayes
(74) *Attorney, Agent, or Firm* — Oblon, McClelland, Maier & Neustadt, L.L.P.

(57) ABSTRACT

A timepiece movement including, fixed on a same plate, a gear train subjected to a torque in a timepiece movement, and an energy storage to deliver a torque to the gear train for actuating a mechanical mechanism synchronizing rotational speed of the gear train with a resonator having a given natural resonant frequency included in the timepiece movement. The resonator is an annular resonator including a ring disposed around an axis. The ring is arranged to be periodically deformed under an action induced by motion of a drive member, included in this mechanism, and the drive member is driven in a pivoting motion, directly or indirectly, by the gear train.

25 Claims, 10 Drawing Sheets

(30) Foreign Application Priority Data

| | | |
|---|---|---|
| Jul. 11, 2014 | (CH) | 1057/14 |
| Jul. 11, 2014 | (EP) | 14176816 |
| Sep. 9, 2014 | (EP) | 14184158 |

(51) Int. Cl.

| | |
|---|---|
| ***G04B 15/14*** | (2006.01) |
| ***G04C 5/00*** | (2006.01) |
| ***G04B 15/12*** | (2006.01) |

(56) References Cited

U.S. PATENT DOCUMENTS

| | | | | |
|---|---|---|---|---|
| 8,794,823 | B2 * | 8/2014 | Vardi | G04C 5/005 310/25 |
| 9,030,070 | B2 * | 5/2015 | Marechal | F16C 32/0408 310/90.5 |
| 9,164,483 | B2 * | 10/2015 | Laesser | G04B 15/08 |
| 2007/0201317 | A1 | 8/2007 | Houlon | |
| 2009/0249873 | A1 * | 10/2009 | Delevoye | G01C 19/574 73/504.12 |
| 2010/0058861 | A1 * | 3/2010 | Kuang | G01C 19/5677 73/504.12 |
| 2013/0009716 | A1 | 1/2013 | Phan Le | |
| 2015/0362892 | A1 * | 12/2015 | Zaugg | G04C 3/064 368/168 |

* cited by examiner

TIMEPIECE SYNCHRONIZATION MECHANISM

CROSS-REFERENCE TO RELATED APPLICATIONS

This is a National Phase Application in the United States of International Patent Application PCT/EP2014/076936 filed Dec. 8, 2014 which claims priority on Swiss Patent Application No. 02140/13 of Dec. 23, 2013, European Patent Application No. 13199427.9 of Dec. 23, 2013, Swiss Patent Application No. 01057/14 of Jul. 11, 2014, European Patent Application No. 14176816.8 of Jul. 11, 2014, European Patent Application No. 14184158.5 of Sep. 9, 2014.

FIELD OF THE INVENTION

The invention concerns a mechanism for synchronizing the rotational speed of a gear train subjected to a torque in a timepiece movement.

The invention also concerns a timepiece movement including, secured on a plate, an energy storage means and a train for actuating such a mechanism.

The invention also concerns a timepiece including one such movement.

The invention concerns the field of the regulation of mechanical timepieces, in particular mechanical watches.

BACKGROUND OF THE INVENTION

In a timepiece escapement mechanism, the efficiency of the Swiss lever escapement that is generally used is relatively low (on the order of 35%).

The main sources of losses in a Swiss lever escapement are:

- the friction of the pallet-stones on the teeth;
- shocks due to the jerky movements of the wheel and the pallet lever;
- the drop necessary to accommodate machining errors.

The development of a new synchronization system in a watch movement, with better efficiency than that of a Swiss lever escapement, may result in:

- an increase in the autonomy of the watch;
- an improvement in the chronometric properties of the watch;
- marketing and aesthetic differentiation.

SUMMARY OF THE INVENTION

The invention proposes to create mechanisms exhibiting greater efficiency than the efficiency of the Swiss lever escapement.

The invention consists of a system for synchronizing a gear train driven by a mainspring with a resonator.

To this end, the invention concerns a mechanism for synchronizing the rotational speed of a gear train subjected to a torque in a timepiece movement, characterized in that said mechanism includes an annular resonator including a ring disposed about an axis, said ring is periodically deformable under the action induced by the motion of a drive member comprised in said mechanism, and said drive member is driven, directly or indirectly, by said torque.

The invention also concerns a timepiece movement including, secured on a plate, an energy storage means and a gear for actuating such a mechanism including an annular resonator, with a ring secured by flexible strips to the plate, and a drive member driven by the gear train, said drive member controlling seconds display means of the movement.

The invention also concerns a timepiece including such a movement, characterized in that said timepiece is a watch.

BRIEF DESCRIPTION OF THE DRAWINGS

Other features and advantages of the invention will appear upon reading the following detailed description, with reference to the annexed drawings, in which:

FIG. 2 shows a neutral state where the ring has a substantially circular profile, between FIGS. 1 and 3 which show profiles of maximum elliptic deformation, with a permutation of the axes of ellipse between these two extreme positions of deformation.

in FIG. 13, externally circular and internally quadrilobate;

in FIG. 14, externally substantially triangular and internally trilobate;

in FIG. 15, substantially circular with a substantially constant section;

in FIG. 16, externally circular and including a plurality of isolated recesses;

in FIG. 17, having a thickness that varies with radius;

in FIG. 18, internally circular and with a plurality of external T-shaped inertia-blocks.

FIG. 20 with a first natural mode in FIG. 22 at 182 Hz, a second natural mode in FIG. 23 at 470 Hz, a third natural mode identical to that of FIG. 23 but orthogonal, not shown, a fourth natural mode in FIG. 24 at 550 Hz, a fifth natural mode in FIG. 25 at 605 Hz, a sixth natural mode in FIG. 26 at 692 Hz;

FIG. 21 with 23 ballasts each of radius 1.0 mm, allowing for a very considerable lowering of the natural mode frequencies: a first natural mode in FIG. 27 at 33 Hz, a second natural mode in FIG. 28 at 85 Hz, a third natural mode identical to that of FIG. 28 but orthogonal, not shown at 89 Hz, a fourth natural mode in FIG. 29 at 96 Hz, a fifth natural mode in FIG. 30 at 148 Hz, a sixth natural mode in FIG. 31 at 155 Hz;

DETAILED DESCRIPTION OF PREFERRED EMBODIMENTS

Hereafter, a "ring" will mean a volume similar to an open torus, spread out, closed on itself, about an axis. This 'ring' is substantially a ring of revolution about the axis, but not necessarily exactly of revolution about the axis.

A specific type of resonator combines the implementation of different waves.

Figure 7:
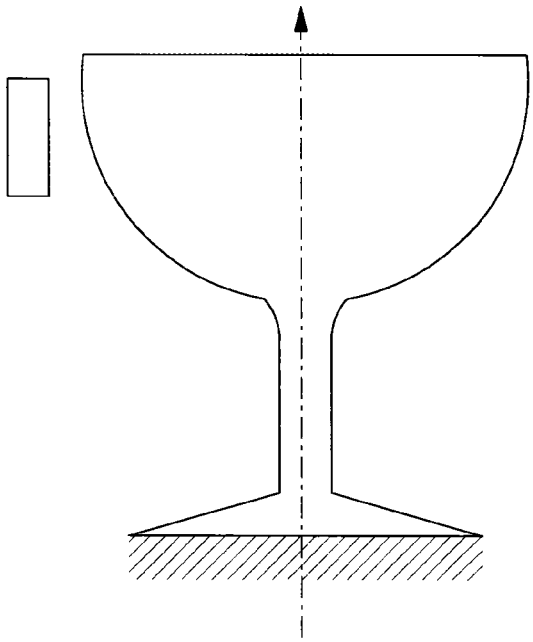
FIG. 7 shows a schematic side view of a 'wine-glass' experiment with an excitation source formed by a loudspeaker in proximity to the 'tulip' of a stemmed glass, whose stem is fixedly held.
Figure 8:
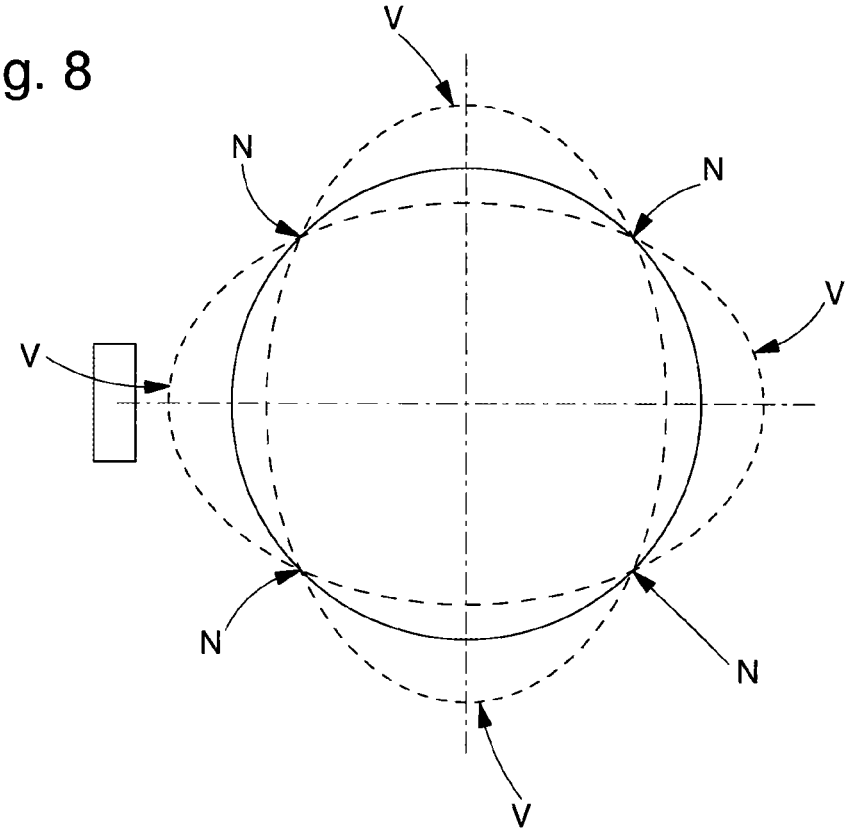
FIG. 8 shows a schematic top view of the glass of FIG. 7 in its different states of elliptic profile deformation, with the distribution of its antinodes and nodes of vibration.

There is, in particular, a known so-called 'wine-glass' laboratory resonator, wherein the 'tulip' of a stemmed glass, whose stem is fixedly held, is subjected to a particular sound excitation. When the excitation frequency, produced by a loudspeaker in proximity to the glass, is chosen to be equal to a resonant frequency of the glass, on the order of 800 to 900 Hz, with a signal power of around 100 W, it is possible to create a wave network in the tulip of the glass causing significant deformations of the tulip, which, seen in a plan view at the opening of the glass, perpendicular to the axis of the stem, gives the edge of the glass an elliptic shape at a given instant, as seen in FIGS. 7 and 8; the latter showing the nodes of vibration N and antinodes V. This elliptic shape is deformable, and maintaining excitation causes the elliptic form to change, modifying its eccentricity, and goes as far as to permute the large axis and the small axis of the ellipse, passing through the position of eccentricity equal to one corresponding to the free shape of the wine-glass edge. These deformations may go as far as to cause the glass to break. When the excitation source is disposed radially, there is observed the presence of four identical vibration antinodes, including one directly opposite the excitation source, the vibration nodes being in directions 45° from the axis defined by the axis of the glass and the excitation source.

This phenomenon is due to a standing wave. This standing wave can be seen as the sum of a progressive wave and a regressive wave propagating in both directions along the edge of the glass, in an annular area, which is substantially of revolution.

The resulting vibration obeys the equation:

$$u(x,t)=f(x+vt)+g(x-vt),$$

where f is the function that qualifies the progressive wave, where g is the function that qualifies the regressive wave.

These functions f and g may be any functions and depend on the initial excitation of the glass.

If one waits for a relatively long time, a standing wave can be obtained.

For example, if f and g are sinusoidal functions:

$$u(x,t)=\sin(kx+\omega t)+\sin(kx-\omega t),$$

the trigonometric relation sin a+sin b=2 sin(a+b)/2 cos(a−b)/2 makes it possible to state that:

$$u(x,t)=2\sin(kx)\cos(\omega t),$$

which is a standing wave: each point oscillates in phase like cos(ω t), but with a different amplitude.

The invention proposes to extend this principle, which has no known industrial application, by exciting only one of the waves, for example the progressive wave, by acting on a deformable ring.

This wave can then rotate at the same speed about the edge of the ring as an excitation source, formed here, in a non-limiting manner, by a drive member, notably formed by a central crank-handle or by a wheel.

As for an escapement, this drive member ensures:

the transmission of energy (maintaining oscillation), and counting, since the drive member rotates at the same speed as the wave.

It should be understood that the speed of propagation of the wave about the ring is a property of the ring, independent of the drive member.

Thus, this drive member must follow the wave, at the same speed as the wave, if the system has been properly dimensioned.

The wave propagates in the material of the ring. The effect of the wave is an elastic deformation of the ring (bending).

Preferably, but in a non-limiting manner, the excitation is continuous. Thus, if the focus is on one point of the ring, the passage of the drive member at one point is similar to a sine wave peak. The signal is preferably periodic.

In the examples illustrated by the Figures, the wave effect related to the presence of the drive member tends to push the ring radially, forcing it to deform elastically.

The excitation wave is a wave of elastic deformation of the ring, which is an almost transverse wave, resulting in an essentially radial deformation.

This explains why, in the illustrated example, starting from a circular ring, the deformation is elliptic with the main axis turning about the centre. Other deformation shapes can evidently be envisaged.

The object subjected to this excitation wave or waves is preferably of substantially annular shape, the toroid ring forming a perfect surface of revolution being a particular case.

This object may be fixedly held like the stem of the glass in the laboratory example described above.

The Figures show variants where fixedly held strips hold the ring. Preferably, these strips are very flexible with respect to the ring, to allow for proper operation.

Indeed, the analogy with the glass stem seems ill-suited to a watch, since this embodiment requires the glass to have a large wall height in order for the edge of the glass to deform, at a sufficient distance from the point of fixed attachment.

The invention concerns a mechanism for synchronizing the rotational speed of a timepiece train by a deformable annular resonator, substantially concentric to the axis of the drive member, which fulfils the function ordinarily assigned to the escape wheel in a conventional timepiece gear train. Preferably, this annular resonator is similar to the 'wine-glass' resonator, as described above. The interaction between the drive member and the resonator may be mechanical or contactless, notably of the magnetic and/or electrostatic type.

More particularly, the invention concerns a mechanism 1 for synchronizing the rotational speed of a gear train 2 of a timepiece movement 10 subjected to a torque, originating from an energy storage means 3 comprised in the movement 10.

According to the invention, this mechanism 1 includes an annular resonator 6 including a ring 7, which is deformable about an axis A under the effect of an action induced by the motion of a drive member 8, comprised in mechanism 1. This drive member 8 is driven, directly or indirectly by the torque, and more specifically, by said energy storage means 3, particularly from a barrel by means of a gear train.

In one implementation of the invention, the speed of drive member 8 defines a propagation speed of a deformation wave in the material of ring 7 all around the latter.

In another implementation of the invention, the speed of drive member 8 defines an oscillating standing wave of ring 7 between repetitive shapes corresponding to standing modes.

In a preferred embodiment, drive member 8 drives a display 4, for example a seconds display of timepiece movement 10.

The movement of drive member 8 includes a pivoting motion. Preferably, the movement of drive member 8 is a pivoting motion.

Figure 15:
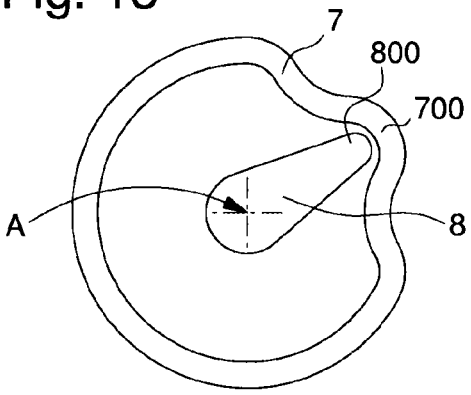
Figure 16:
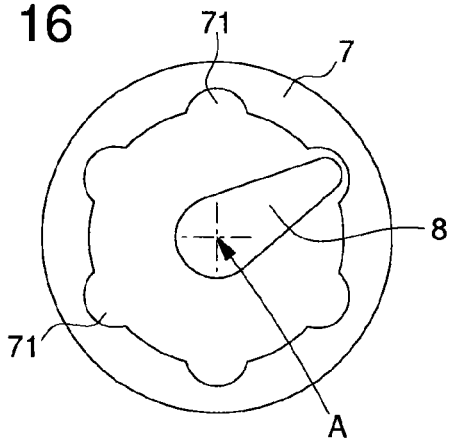
Figure 17:
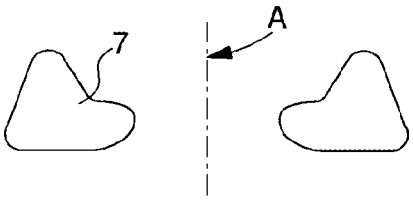
Figure 18:
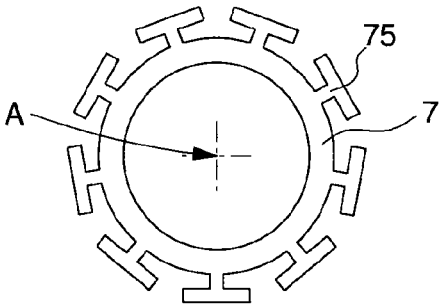
Figure 19:
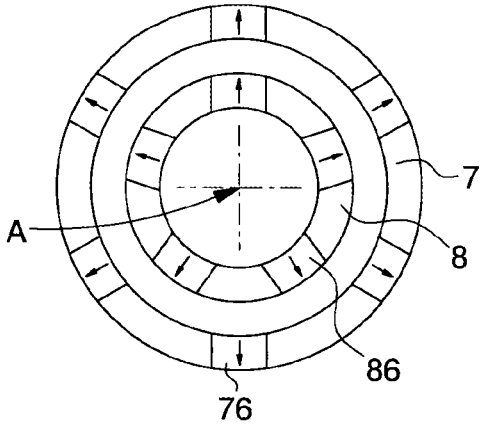
FIG. 19 illustrates the cooperation of a ring and a drive member both of which are substantially annular and include a plurality of magnetic paths.
Figure 20:
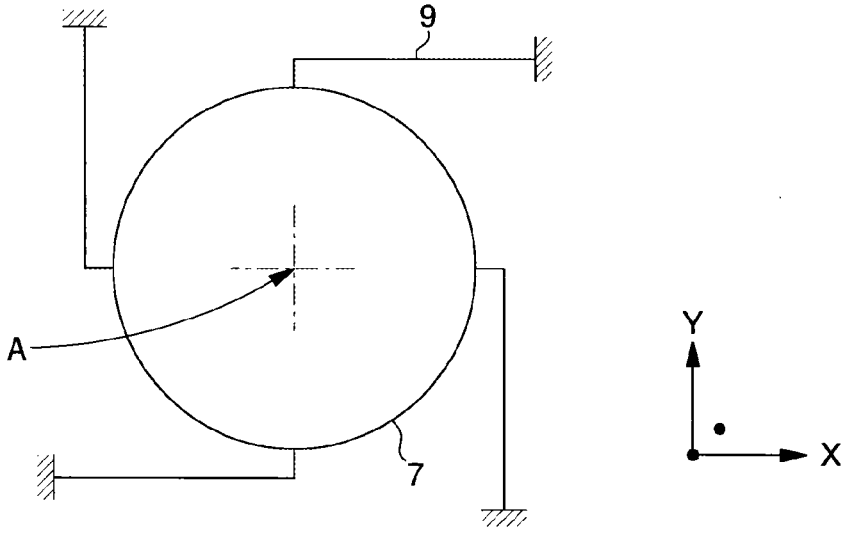
FIGS. 20 to 31 illustrate the natural modes of such a resonator in the plane XY, with a ring of diameter 14.00 mm, of a thin type, with a thickness and height of 0.01 mm, made of silicon with a Young's modulus of 146 GPa, a density of 2329 kg/m$^3$, and a Poisson's ratio of 0.26.
Figure 21:
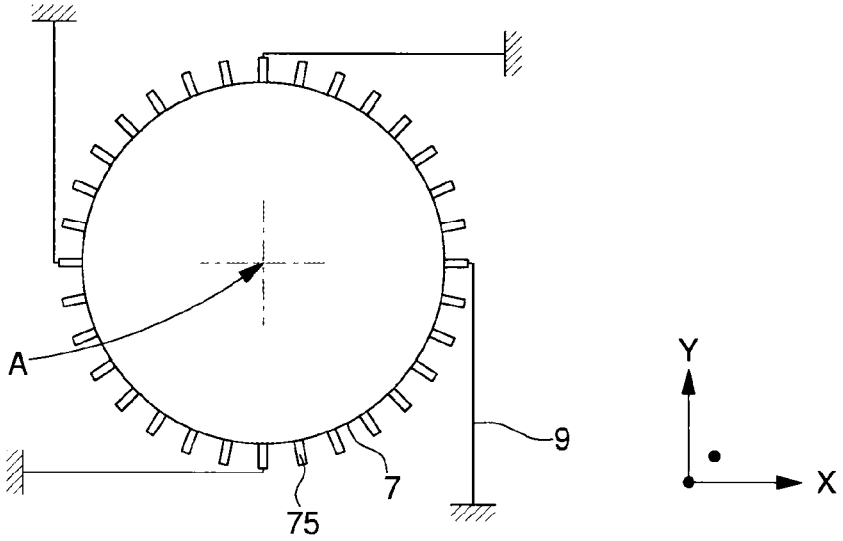
Figure 22:
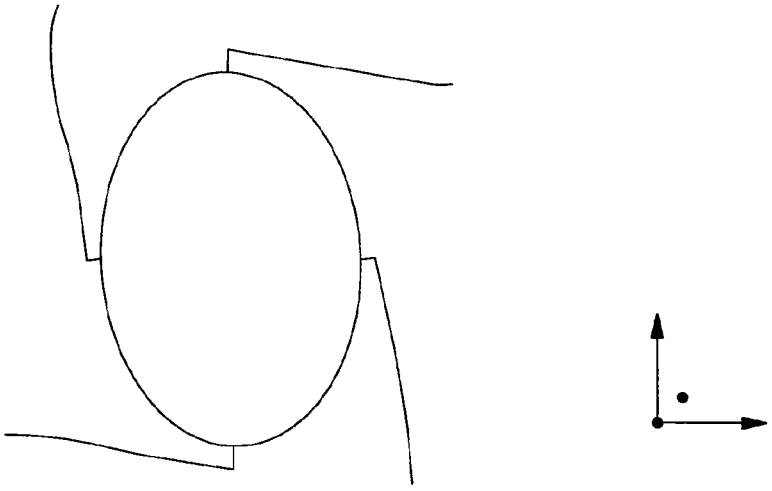
Figure 23:
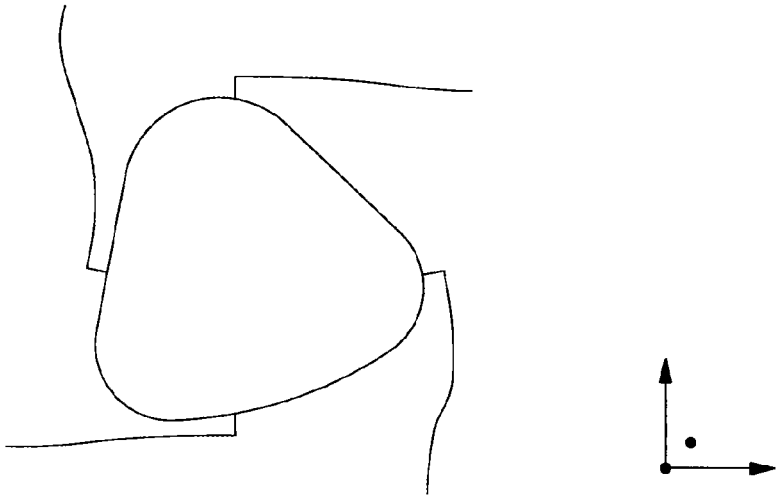
Figure 24:
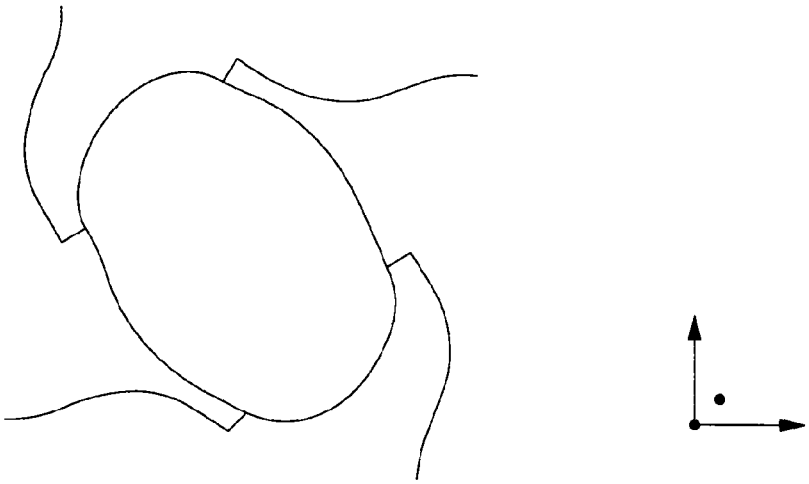
Figure 25:
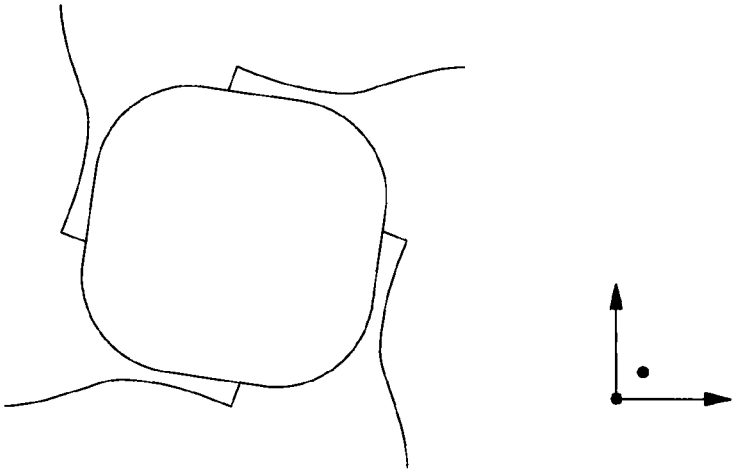
Figure 26:
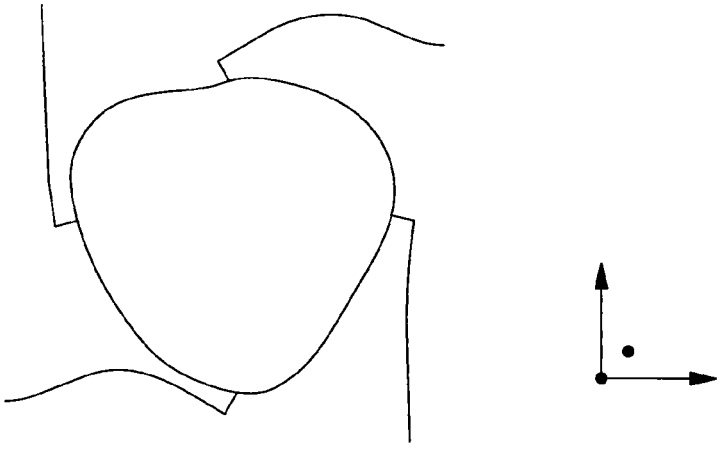
Figure 27:
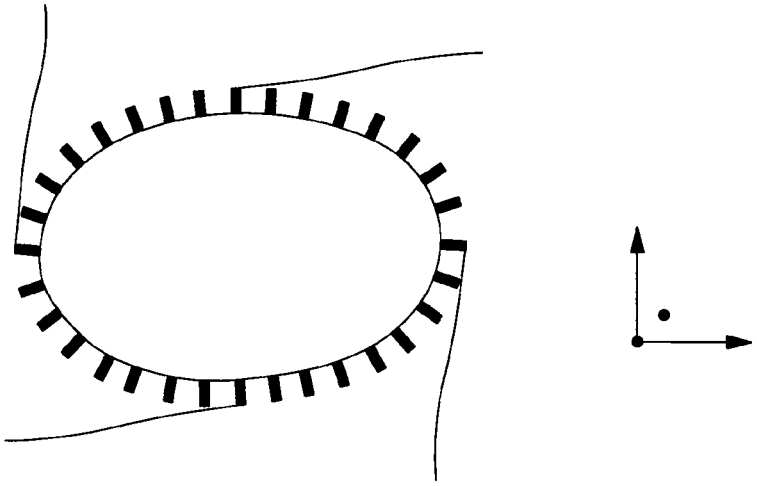
Figure 28:
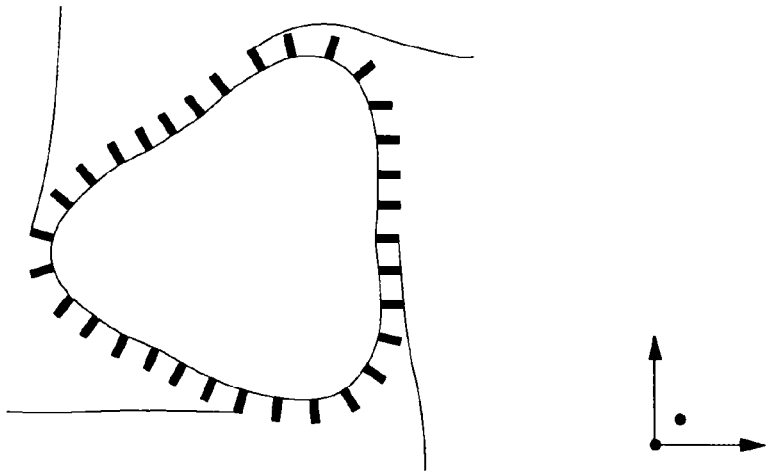
Figure 29:
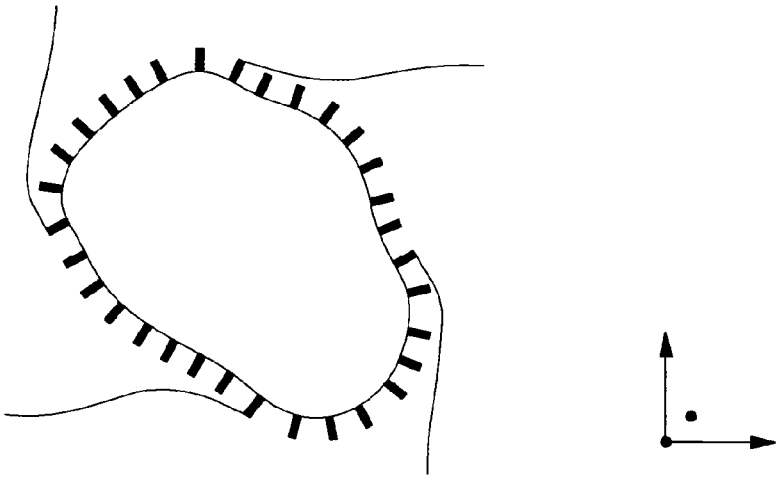
Figure 30:
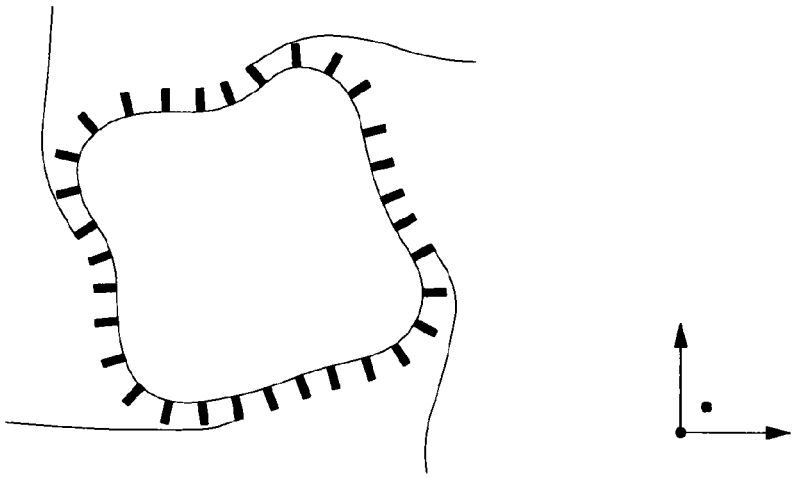
Figure 31:
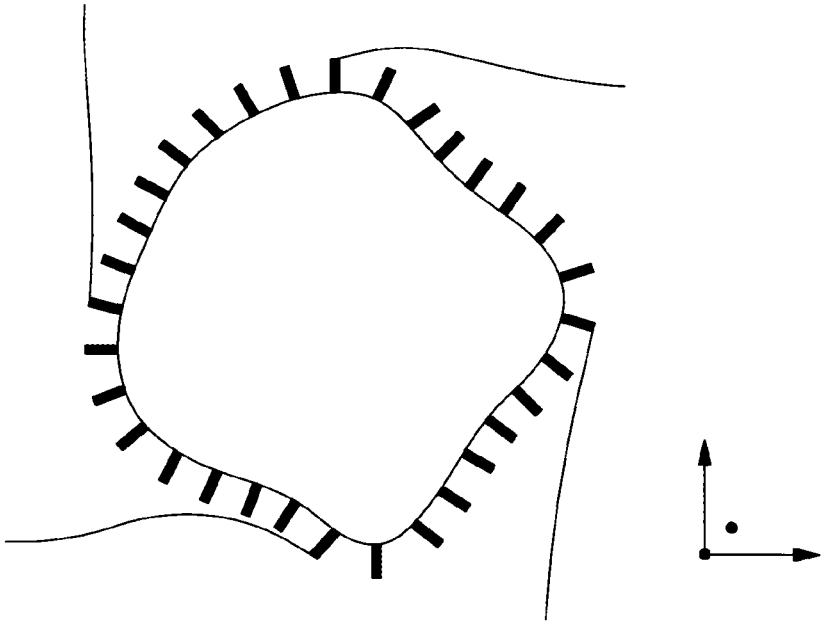

In one implementation of the invention, as seen in FIG. 15, drive member 8 includes at least one distal end 800 which extends, with respect to axis A, beyond the smallest diameter exhibited, in an unrestricted free state, by a ring 7 with respect to axis A. More particularly, at least one distal end 800 locally deforms ring 7 into the shape of a bulge portion 700 projecting radially outwards with respect to axis A.

More specifically, at least one distal end 800 is arranged to cooperate with at least one recess 71 comprised, in an unrestricted free state, in ring 7 at the inner periphery thereof on the side of axis A.

In a particular embodiment, ring 7 includes, in an unrestricted free state, at the inner periphery thereof on the side of axis A, at least one bulge 70 facing axis A forming the smallest diameter exhibited by ring 7 with respect to axis A.

In a particular embodiment, the interaction between drive member 8 and annular resonator 6 is mechanical.

In a particular static embodiment, drive member 8 exerts at least one radial force with respect to axis A in a centrifugal direction on ring 7.

In a preferred embodiment, ring 7 is secured to a plate 5 comprised in said timepiece movement 10 by a plurality of flexible strips 9, which, in a first alternative, are more flexible than ring 7, arranged to hold ring 7 substantially centred on said axis A, and to restrict the motions of ring 7 in the same plan P perpendicular to axis A with limited movements of the centre of inertia of ring 7 smaller than one tenth of the smallest external dimension of ring 7 in said plane P.

In a second alternative, these flexible strips 9 are more rigid than ring 7.

Figure 1:
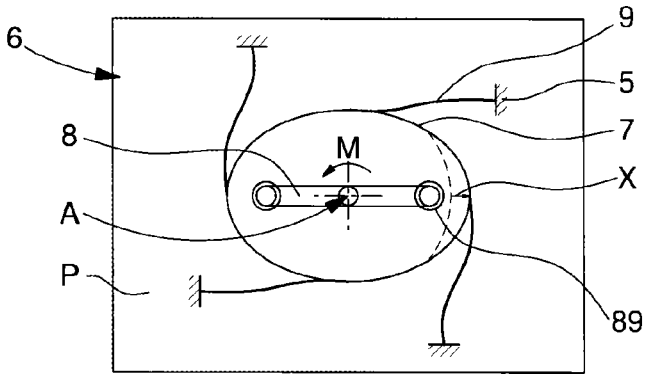
FIGS. 1 to 3 show schematic plan views of a mechanism for synchronizing the rotational speed of a gear train of a timepiece movement according to the invention, including an annular resonator with a deformable ring, whose deformation is induced by a drive member acting as a crank-handle, which pivots about the axis of said ring.
Figure 2:
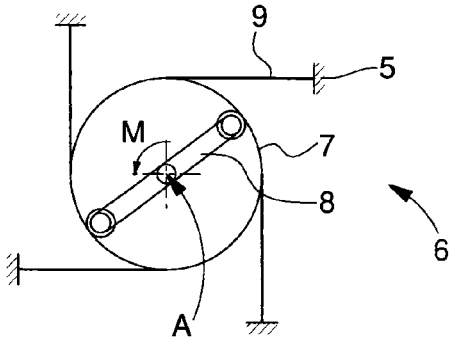
Figure 3:
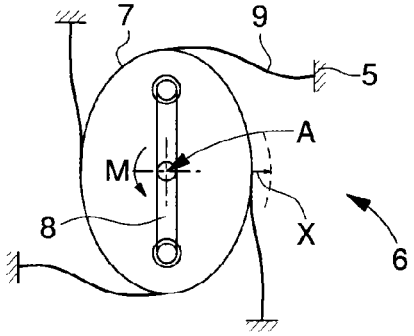

In a first variant embodiment, as seen in FIGS. 1 to 4 and 9 to 11, an annular 'wine-glass' type resonator 6 is synchronized with a drive member 8 acting as a crank-handle. FIG. 2 shows the shape of the resonator at rest, and FIGS. 1 and 3 show the extreme states that annular resonator 6 can take during the progression of the crank-handle.

Figure 9:
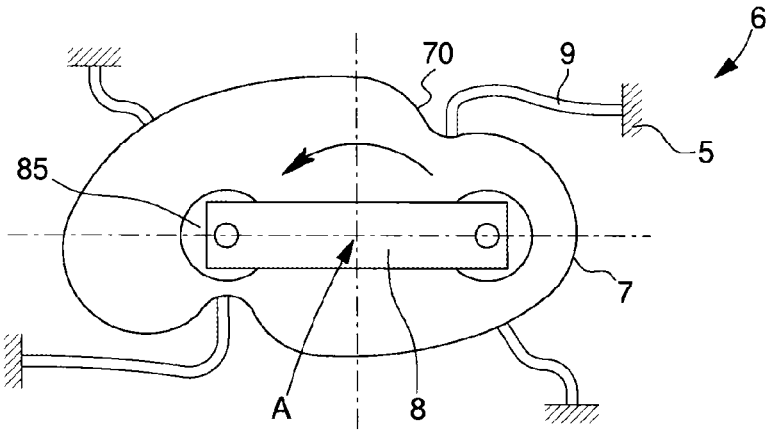
FIGS. 9 to 11 are similar to FIGS. 1 to 3, with a ring which is not exactly circular in the free state, but includes bulged portions forming energy thresholds, and wherein the attachments of the flexible strips connecting the ring to the plate are in the diagonals of the large and small axes of the ellipse.
Figure 10:
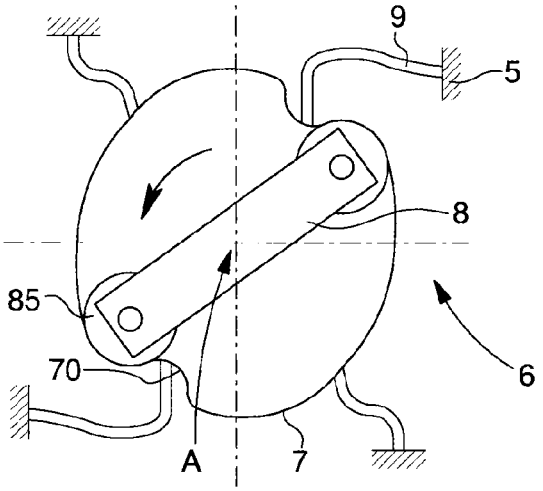
Figure 11:
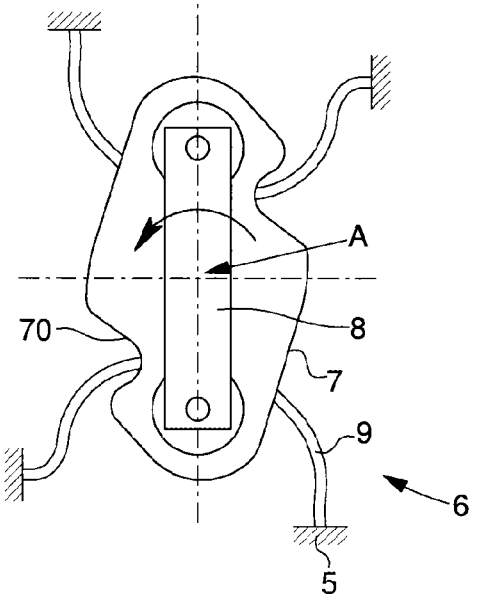
Figure 12:
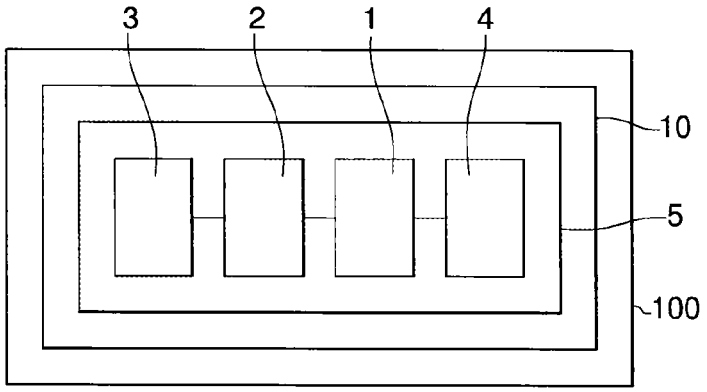
FIG. 12 is a block diagram illustrating a timepiece including a movement incorporating a mechanism according to the invention.
Figure 13:
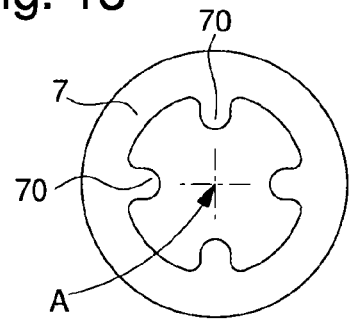
FIGS. 13 to 18 illustrate specific non-limiting ring shapes suitable for implementing the invention.
Figure 14:
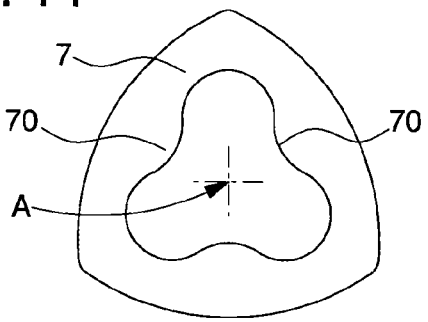

Advantageously, ring 7 of annular resonator 6 is secured to a plate 5 comprised in timepiece movement 10 by a plurality of flexible strips, 9 more flexible than ring 7, and which are arranged to hold ring 7 centred on axis A, and to restrict the motions of ring 7 in the same plane P perpendicular to axis A to very small travels, particularly travels smaller than one tenth of the smallest external dimension of ring 7 in this plane P. In the preferred case illustrated, at rest, ring 7 has a substantially circular shape, this smaller dimension is the length of the small axis of the ellipse corresponding to an extreme deformation of ring 7. FIGS. 9 to 11 illustrate a similar configuration, but where flexible strips 9 are attached to areas capable of becoming vibration nodes, at 45° modulo 90° with respect to the horizontal axis of the Figures, and where the annular resonator is not strictly of revolution in the free state, but includes two constricted portions, as seen in FIG. 10, forcing the drive member to exert on the ring an additional radial force in order to cross them.

The interaction between drive member 8 and annular resonator 6 is of a mechanical type, and drive member 8 induces a centrifugal radial force on ring 7.

In a second variant embodiment, the interaction between drive member 8 and annular resonator 6 is achieved by magnetic interaction means 11 including magnets and/or magnetic poles.

In a particular embodiment, ring 7 includes a plurality comprising a first number of magnets or magnetic poles, drive member 8 includes a plurality comprising a second number of magnets and magnetic poles, the first number being different from the second number, so that ring 7 and drive member 8 together form a speed reducing or increasing mechanism. More particularly, the first number differs from the second number by one unit.

In a particular embodiment, the shape of magnetic interaction means 11 or of the magnets defines first areas forming potential ramps and second areas forming potential barriers, in order to confine an impulse between drive member 8 and annular resonator 6.

In a third variant, the interaction between drive member 8 and annular resonator 6 is achieved by electrostatic interaction means including electrets and/or electrostatically conductive poles.

Figure 5:
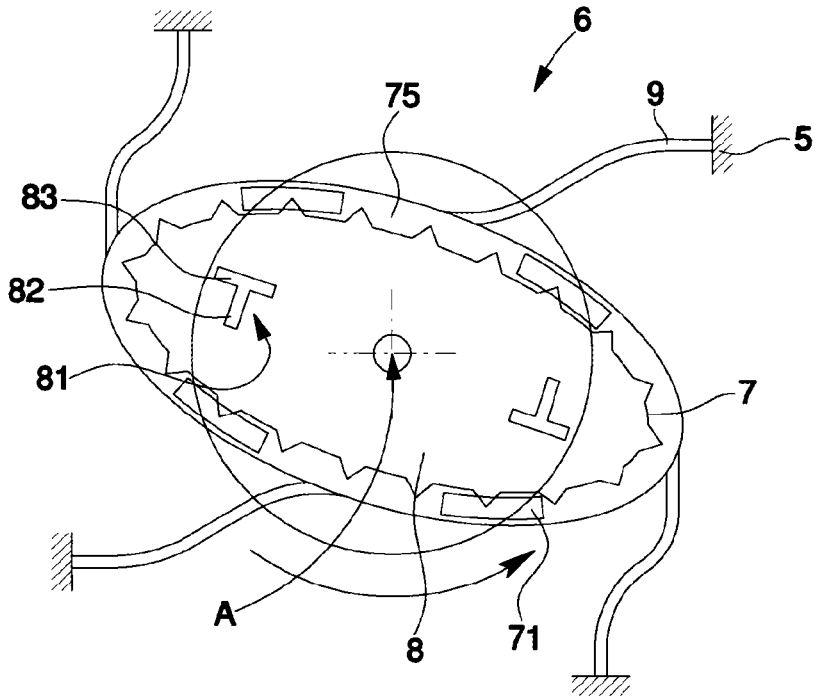
FIG. 5 shows a schematic plan view of a variant with an annular 'wine-glass' type resonator, which is weighted to lower the natural frequency, and magnetically synchronized with a wheel, which includes magnetic areas arranged to cooperate with magnetic paths of the ring to generate deformations and/or impulses.

In the second or third variant, and as seen in FIG. 5, the shape of magnetic, respectively electrostatic interaction means 11, or of said magnets, respectively electrets, defines first areas forming potential ramps and second areas forming potential barriers, in order to confine an impulse between drive member 8 and annular resonator 6. In the non-limiting embodiment of FIG. 5, drive member 8 carries T-shaped magnets 81 which, in certain relative positions of drive member 8 and ring 7, will first of all achieve partial superposition and then total superposition with areas of ring 7, which may or may not be equipped with magnetic paths 71. The cooperation between magnets 81 and paths 71 is progressive: a first branch 82 of magnet 81 starts to cooperate with the opposing magnetic path 71, forming a potential ramp, then a transverse bar 83 of magnet 81 forms a real potential barrier generating an impulse.

In an advantageous variant illustrated in FIGS. 4 and 5, 21 and 27 to 31, ring 7 is weighted at its periphery, continuously or periodically, for example by inertia-blocks 75 giving the ring 7 thereby equipped, the appearance of a vehicle track FIGS. 27 to 31 illustrate the advantage provided by these ballasts in lowering the frequency of the first natural modes.

More particularly, ring 7 is weighted on its periphery in a continuous or periodic manner.

In a particular embodiment, ring 7 is weighted by a plurality of inertia-blocks 75.

In a particular embodiment, at least some inertia-blocks 75 extend outwardly of ring 7 with respect to axis A, with a T-shaped profile whose vertical bar is radial with respect to axis A, and whose transverse bar is perpendicular to axis A and the furthest therefrom.

Figure 4:
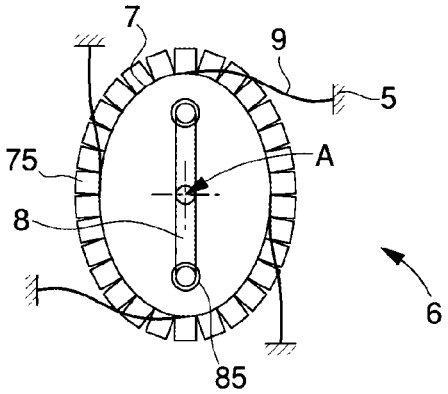
FIG. 4 shows a schematic plan view of a variant with a 'wine-glass' type annular resonator, which is weighted to lower the natural frequency and synchronized with a drive member acting as a crank-handle.

FIG. 4 thus illustrates an annular 'wine-glass' resonator 6 weighted in order to lower the natural frequency, and synchronized with a crank-handle. FIG. 5 illustrates a 'wine-glass' annular resonator 6 weighted in order to lower the natural frequency, and magnetically synchronized with a wheel.

The use of magnets as interaction elements between the wheel and the resonator makes it possible to remove friction losses, shock noise and losses due to "drops". The shape of the magnets can be optimised to obtain a ramp/barrier effect for confining the impulse.

In a first mechanical variant, drive member 8 is advantageously a crank-handle inducing a mechanical deformation of ring 7.

Figure 6:
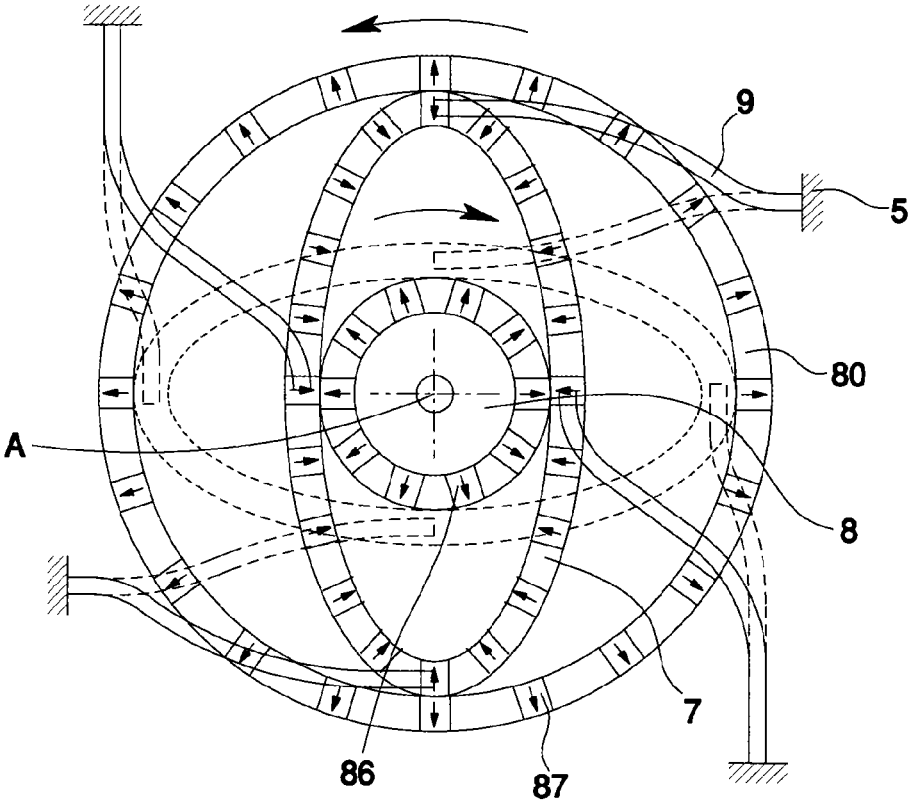
FIG. 6 shows a schematic plan view of a variant including an annular 'wine-glass' type resonator, which is weighted to lower the natural frequency, and magnetically synchronized with a wheel.

In embodiments such as those of FIGS. 5 and 6, drive member 8 is a wheel arranged to exert a contactless force on ring 7.

In a particular embodiment, the wheel carries an arm forming a crank-handle provided with at least one roller 85 arranged to roll or slide on the inner peripheral surface of ring 7 on the side of axis A.

In one or other of the embodiments described above, ring 7 may have variable sections and/or thicknesses along its periphery.

In a particular embodiment, in an unrestricted free state, ring 7 has a polygonal or polylobate shape in a plane P orthogonal to axis A.

In a particular and preferred embodiment, ring 7 is made of micromachinable material or silicon and has a rectangular section in any plane passing through said axis A In a particular embodiment, ring 7 is made in one-piece with a plurality of flexible strips 9 for connection to a plate 5 comprised in timepiece movement 10. More particularly, ring 7 is made in one-piece with the plurality of flexible strips 9 and with plate 5.

In a particular embodiment, drive member 8 is driven by a speed reducing or increasing mechanism inserted between energy storage means 3 and drive member 8. This speed reducing or increasing mechanism is a magnetic coupling mechanism, as seen in FIG. 6, which illustrates a 'wine-glass' annular resonator 6 weighted in order to lower the natural frequency, and magnetically synchronized with a wheel, via a magnetic speed increasing gear, arranged to have an escape wheel which rotates at a lower frequency than the natural frequency of the resonator.

In a particular embodiment, drive member 8 includes a first disc comprising alternating magnetic fields 81 with a first pitch, and which cooperate with the second disc comprising magnetic fields 82 with a second pitch, very close to but different from the first pitch.

Another variant, not illustrated, consists in the combination of a mechanical and magnetic or electrostatic interaction.

The invention also concerns a timepiece movement 10 including, secured on a plat 5*e*, an energy storage means 3 arranged to deliver torque to a gear train 2 for actuating such a mechanism 1 including an annular resonator 6, with a ring 7 secured by flexible strips 9 to the plate 5, and a drive member 8 driven by the gear train 2, said drive member 8 controlling display means 4, particularly for the seconds display, of the movement 10.

The invention also concerns a timepiece 100 including one such movement 10. More particularly, this timepiece 200 is a watch.

The invention presents significant advantages: the invention makes it possible to eliminate the jerky motions of a Swiss lever escapement and thereby losses due to shocks. The efficiency of the escapement is substantially increased.

Such an annular resonator does not have pivots, and thus does not bear the friction losses of the pivots of a balance spring.

Owing to the absence of jerky motions, it is possible to increase the frequency of the resonator and consequently the quality factor and accuracy of the watch.

Variants with a crank-handle are purely mechanical synchronization systems, which cannot be uncoupled.

The invention proposes an innovation in the field of escapements and of resonators. It also has a strong emotional potential because of its visual similarity to a beating heart.

The invention claimed is:

1. A timepiece movement comprising:

a gear train subjected to a torque in the timepiece movement;

a mechanical mechanism including a resonator; and an energy storage mechanism to deliver a torque to the gear train to actuate the mechanical mechanism to synchronize the gear train with the resonator having a given natural resonant frequency included in the timepiece movement, wherein the gear train, the mechanical mechanism, and the energy storage mechanism are fixed on a same plate, the resonator is an annular resonator including a ring disposed around an axis, the ring is configured to be periodically deformed by an action induced by motion of a drive structure, included in the mechanical mechanism, and the drive structure is driven in a pivoting motion, directly or indirectly, by the gear train, interaction between the drive structure and the annular resonator is achieved by a magnetic interaction mechanism including magnets and/or magnetic poles, and the ring includes a plurality of a first number of magnets or magnetic poles, the drive structure includes a plurality of a second number of magnets or magnetic poles, and the first number is different from the second number, so that the ring and the drive structure together form a speed reducing or increasing mechanism.

2. The movement according to claim 1, wherein the first number differs from the second number by one unit.

3. The movement according to claim 1, wherein a shape of the magnetic interaction mechanism or of the magnets defines first areas forming potential ramps and second areas forming potential barriers, to confine an impulse between the drive structure and the annular resonator.

4. The movement according to claim 1, wherein the drive structure is a wheel configured to exert a contactless effort on the ring.

5. The movement according to claim 4, wherein the wheel carries an arm forming a crank-handle provided with at least one roller configured to roll or slide on an inner peripheral surface of the ring on a side of the axis.

6. The movement according to claim 1, wherein the given natural resonant frequency defines a speed of propagation of a deformation wave in a material of the ring all around the ring, during motion of the drive structure that follows the wave, at a same speed as the wave.

7. The movement according to claim 1, wherein the given natural resonant frequency defines a standing wave of oscillation of the ring between repetitive forms corresponding to stationary modes, during motion of the drive structure, which follows the wave, at a same speed as the wave.

8. The movement according to claim 1, wherein the drive structure drives a display of the timepiece movement.

9. The movement according to claim 1, wherein the motion of the drive structure includes at least one pivoting motion.

10. The movement according to claim 9, wherein the motion of the drive structure is a pivoting motion.

11. The movement according to claim 1, wherein the drive structure includes at least one distal end that extends, with respect to the axis, beyond a smallest diameter exhibited by the ring with respect to the axis.

12. The movement according to claim 11, wherein the ring includes a bulge portion projecting radially outwards with respect to the axis.

13. The movement according to claim 11, wherein the at least one distal end is configured to cooperate with at least one recess included, in an unstressed free state, in the ring at an inner periphery thereof on a side of the axis.

14. The movement according to claim 1, wherein the ring includes, in an unstressed, free state, at an inner periphery thereof on a side of the axis, at least one bulge portion facing the axis forming a smallest diameter exhibited by the ring with respect to the axis.

15. The movement according to claim 1, wherein the ring is secured to the plate by a plurality of flexible strips, more flexible than the ring, configured to maintain the ring substantially centered on the axis, and to restrict motions of the ring in a same plane perpendicular to the axis with limited motions of a center of inertia of the ring smaller than one tenth of a smallest external dimension of the ring in the plane.

16. The movement according to claim 15, wherein the ring is in one piece with the plurality of flexible strips to connect to the plate.

17. The movement according to claim 1, wherein the ring is secured to the plate by a plurality of flexible strips, more rigid than the ring, configured to maintain the ring substantially centered on the axis, and to restrict motions of the ring in a same plane perpendicular to the axis with limited motions of a center of inertia of the ring smaller than one tenth of a smallest external dimension of the ring in the plane.

18. The movement according to claim 17, wherein the ring is in one piece with the plurality of flexible strips and with the plate.

19. The movement according to claim 1, wherein the ring is weighted on a periphery thereof, in a continuous or periodic manner.

20. The movement according to claim 19, wherein the ring is weighted by a plurality of inertia-blocks.

21. The movement according to claim 20, wherein at least some of the inertia-blocks extend outwardly of the ring with respect to the axis, with a T-shaped profile whose vertical bar is radial with respect to the axis, and whose transverse bar is perpendicular to the axis and furthest therefrom.

22. The movement according to claim 1, wherein the ring includes variable sections and/or thicknesses along a periphery thereof.

23. The movement according to claim 1, wherein, in an unstressed, free state, the ring has a polygonal or polylobate shape in a plane orthogonal to the axis.

24. The movement according to claim 1, wherein the ring is made of micromachinable material or silicon and has a rectangular section in every plane passing through the axis.

25. A timepiece including a movement according to claim 1, wherein the timepiece is a watch.

* * * * *